United States Patent [19]

Eisinger

[11] Patent Number: 4,796,690

[45] Date of Patent: Jan. 10, 1989

[54] SUPPORT SYSTEM FOR HEAT EXCHANGE TUBE

[75] Inventor: Frantisek L. Eisinger, Demarest, N.J.

[73] Assignee: Foster Wheeler Energy Corporation, Clinton, N.J.

[21] Appl. No.: 36,821

[22] Filed: Apr. 8, 1987

Related U.S. Application Data

[63] Continuation-in-part of Ser. No. 799,389, Nov. 18, 1985, abandoned.

[51] Int. Cl.[4] ..... F22B 37/24

[52] U.S. Cl. ..... 165/67; 122/510; 165/162

[58] Field of Search ..... 165/171, 67, 162; 122/510

[56] References Cited

U.S. PATENT DOCUMENTS

| | | | |
|---|---|---|---|
| 1,527,811 | 2/1925 | Matlock | 122/510 X |
| 2,067,671 | 1/1937 | Kooistra | 122/510 X |
| 2,757,649 | 8/1956 | Coughlin | 122/510 X |
| 3,055,349 | 9/1962 | Hamilton et al. | 122/510 |

*Primary Examiner*—Ira S. Lazarus
*Assistant Examiner*—Richard R. Cole
*Attorney, Agent, or Firm*—Marvin A. Naigur; Warren B. Kice

[57] ABSTRACT

A heat exchange apparatus in which a plurality of heat exchange tubes are disposed in a enclosure and are supported relative to two opposed upright walls of the enclosure. Each tube is formed in a serpentine manner with adjacent tube sections extending in a vertically spaced parallel relationship between the upright walls. Adjacent tube sections are connected at a distance from each of the walls of between one-fourth and one-third the distance between the two walls.

3 Claims, 1 Drawing Sheet

SUPPORT SYSTEM FOR HEAT EXCHANGE TUBE

CROSS REFERENCE TO RELATED APPLICATION

This application is a continuation-in-part of co-pending application U.S. Ser. No. 799,389, filed Nov. 18, 1985 now abandoned.

BACKGROUND OF THE INVENTION

The present invention relates to a heat exchanger and, more particularly, to a system for supporting heat exchange tubes in the heat exchanger.

In various types of heat exchangers, such as vapor generators, or the like, heat exchange tubes are normally supported in an elevated position above the furnace section, and fluid is continuously circulated through the tubes to pick up heat generated in the furnace.

The tubes are usually bent in a serpentine manner and, in smaller units, are supported only at their end portions. However in larger units having a relatively large span between opposed walls, tubes that are supported only at their ends will deflect to the extent that severe stresses are introduced. This requires fairly complicated support systems for supporting the tubes, such as vertical support members which are welded to the tubes. These type of support systems are expensive, and the relative thermal expansion between the support members and the tubes causes additional problems.

SUMMARY OF THE PRESENT INVENTION

It is therefore an object of the present invention to provide a simple, yet efficient, support system for supporting a plurality of heat exchange tube sections in a vapor generator.

It is a further object of the present invention to provide a support system of the above type in which the tube sections are connected to each other near an external support member mounted to each of two opposed walls of the vapor generator and at one intermediate point between said support members.

Toward the fulfillment of these and other objects the support system of the present invention consists of a series of lugs connecting adjacent tube sections of the heat exchange tubes near each of two opposed walls of a vapor generator and at a distance from each of the opposed walls between one fourth and one third the distance between the two walls.

BRIEF DESCRIPTION OF THE DRAWINGS

The above brief description as well as further objects, features and advantages of the present invention will be more fully appreciated by reference to the following detailed description of presently preferred, but nonetheless illustrative, embodiments in accordance with the present invention when taken in conjunction with the accompanying drawings wherein.

DESCRIPTION OF PREFERRED EMBODIMENTS

Figure 1:
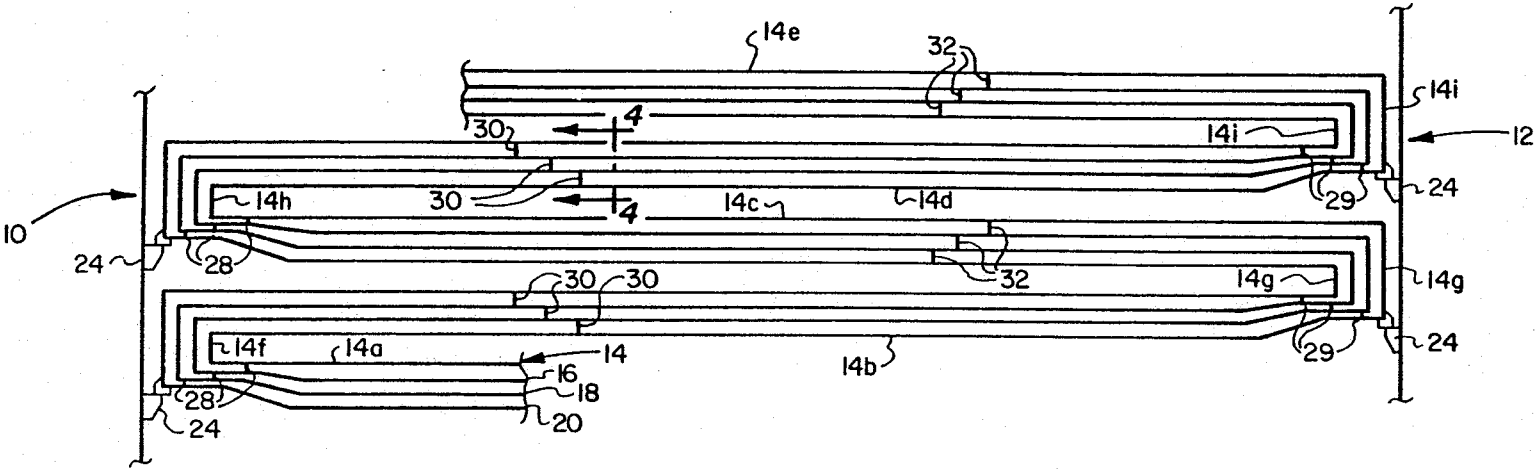
FIG. 1 is a schematic representation of the heat exchange tubes of a vapor generator and the support system of the present invention for supporting same.

Referring specifically to FIG. 1 of the drawings, the reference numerals 10 and 12 refer in general to the opposed wall portions of an enclosure section of a vapor generator. Although the wall sections 10 and 12 are shown schematically, it is understood that they would be formed by a plurality of spaced parallel tubes connected in a manner to form an air tight enclosure, in a conventional manner.

Four bundles of heat exchange tubes, shown in general by the reference numerals 14, 16, 18, and 20, extend between the upright wall sections 10 and 12. Although only one tube of each bundle is shown in the drawings, it is understood that each bundle consists of a plurality of tubes disposed in a parallel relationship spaced in the plane of the drawing.

Each tube 14, 16, 18, and 20 is formed in a serpentine, or coiled, configuration and, as such, has several horizontal sections, each spanning the distance between the walls 10 and 12. For example, each tube 14 in its tube bundle has five horizontal sections **14*a*, 14*b*, 14*c*, 14*d*, and 14*e***.

Each tube 14, 16, 18, and 20 also has a bent portion including a vertical section which extends between corresponding horizontal sections near the walls 10 and 12. For example, each tube 14 in its tube bundle has vertical sections **14*f* and 14*h* located adjacent the wall 10 and sections 14*g* and 14*i* located adjacent the wall 12. Although not shown in the drawings, it is understood that the tubes 16, 18, and 20 are configured similarly, and that the respective end portions of each tube extend through the walls 10 and 12** where they are connected to conventional headers or the like for circulating fluid through each tube.

Figure 3:
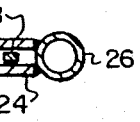
FIG. 3 is a sectional view taken along the line 3—3 of FIG. 2.
Figure 2:
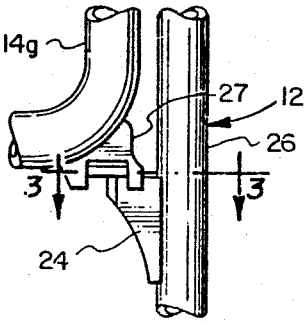
FIG. 2 is an enlarged elevational view showing an end support for the tubes.

Each tube 14 in its tube bundle is supported adjacent the wall 12 in the manner shown in FIG. 2. More particularly, a female lug member 24 is welded to a vertical water tube 26 forming a portion of the wall 12. A male lug member 27 is welded to the lower surface of the bent tube section of each tube 14 and engages within the female lug member 24 in a manner better shown in connection with FIG. 3. This supports each tube 14 of its tube bundle relative to the wall 12. It is understood that the lug members 24 and 27 are utilized in an identical manner to support each tube 20 in its tube bundle relative to the wall 10.

A first and second series of rigid lugs 28 and 29 are disposed between the adjacent lower horizontal sections of the tubes of the respective tube bundles 14, 16, 18, and 20 near the walls 10 and 12, respectively. Thus the lower section of the tube 14 is supported by a lug 28 extending between it and the adjacent lower section of the tube 16, the latter section is supported by another lug 28 extending between it and the adjacent lower section of the tube 18, the latter section is supported by another lug 28 extending between it and the adjacent lower section of the tube 20, and the latter section is supported by the lug members 24 and 27. The lugs 29 support the corresponding horizontal sections of the tube 14, 16, 18, and 20 located adjacent the wall 12 in a similar manner. The lugs 28 and 29 are offset, or staggered in a horizontal direction as viewed in FIG. 1.

A third and fourth series of lugs 30 and 32 respectively, are formed between the adjacent horizontal sections of the tubes 14, 16, 18, and 20 at a predetermined distance from the walls 10 and 12, respectively. More particularly, and referring again to FIG. 1, a plurality of lugs 30 extend between adjacent tube sections of the tubes 14, 16, 18, and 20. The lugs 30 are offset, or staggered, in a horizontal direction and the lugs 32 are formed and disposed in a similar manner in a spaced relation to the lugs 30.

The distance of the series of lugs 30 and the series of lugs 32 from the walls 10 and 12, respectively, is between one-fourth and one-third the distance between the two walls 10 and 12. For example, if the distance between the walls 10 and 12 is 100 units, the lugs 30 would be located between 25 and 30 units from the wall 10, and the lugs 32 would be between 25 and 30 units from the wall 12.

Figure 4:
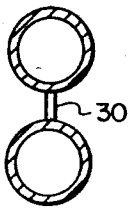
FIG. 4 is an enlarged, sectional view taken along the line 4—4 of FIG. 1.

As better shown in FIG. 4, each lug 30 (and 32) extends perpendicularly to the axes of its corresponding tube sections and is secured thereto in any conventional manner such as by welding. Although not shown in detail it is understood that the lugs 28 and 29 are identical to the lugs 30 and 32.

As a result of the foregoing, the various sections of the tubes 14, 16, 18, and 20 are self supporting, i.e. they require no other external support to prevent sagging and/or undue stresses being placed thereon other than the lug members 24, 27, 28 and 29 which support the tube sections located adjacent the walls 10 and 12.

It is understood that, although only one tube 14, 16, 18, and 20 of each bundle is shown in the drawings and described above, each tube is a part of a bundle of tubes which are configured and supported in an identical manner.

Figure 6:
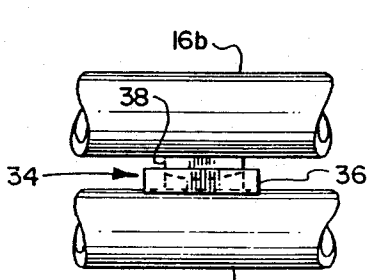
FIG. 6 is a sectional view taken along the line 6—6 of FIG. 5.
Figure 5:
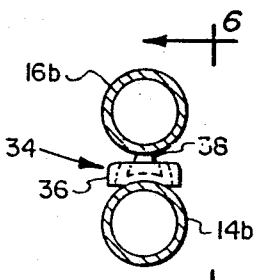
FIG. 5 is a view similar to FIG. 4 but depicting an alternate embodiment of the present invention.

FIGS. 5 and 6 show a hinge assembly 34 for connecting the adjacent tube sections forming an alternate embodiment of the present invention. For the purposes of example, two adjacent tube sections are referred to by the reference numerals **14*b* and 16*b*, it being understood that the assembly 34 is also disposed in a similar manner between the horizontal tube sections of the tubes of the tubes 16 and 18 and between the horizontal tube sections of the tubes 18 and 20. More particularly, each hinge assembly 34 comprises a female lug member 36 welded to the upper surface of the tube section 14*b*, and a male lug member 38 welded to the lower surface of the adjacent tube section 16*b*. The male lug member 38 extends within a corresponding channel formed in the female lug member 36 to provide a connection between the tube sections 14*b* and 16*b*, while permitting a slight horizontal movement therebetween. Since the lug members 32 and 34** are of a conventional design they will not be described in any further detail.

It is thus seen that the support system of both embodiments of the present invention provides an efficient yet simple, means of supporting adjacent tube sections of tube bundles while eliminating the use of any external support system other than those provided at the walls 10 and 12.

A latitude of modification, change and substitution is intended in the foregoing disclosure and in some instances some features of the invention will be employed without a corresponding use of other features. Accordingly, it is appropriate that the appended claims be construed broadly and in a manner consistent with the spirit and scope of the invention therein.

What is claimed is:

1. A heat exchange apparatus comprising an enclosure, a plurality of heat exchange tubes disposed in said enclosure, means for supporting each tube relative to two opposed upright walls of said enclosure, each tube being formed in a serpentine manner with adjacent tube sections of each tube extending horizontally in a vertically spaced, parallel relationship between said upright walls, a first and second series of connector means connecting adjacent tube sections adjacent said two opposed walls, respectively, a third series of connecting means connecting adjacent tube sections at a distance from one of said walls between one-fourth and one-third the distance between said walls, and a fourth series of connecting means connecting said adjacent tube sections at a distance form the other of said walls between one-fourth and one-third said distance between said walls, each connecting means being offset from its adjacent connecting means in a horizontal direction said connecting means constituting the only support between said adjacent sections.

2. The apparatus of claim 1 wherein each connecting means comprises a vertical spacer member welded at each end to said adjacent sections.

3. The apparatus of claim 1 wherein said third and fourth connecting means comprises a male and female lug member respectively welded to said adjacent sections, said male lug member extending in said female lug member to connect said adjacent sections while allowing slight movement therebetween.

* * * * *